United States Patent [19]

Epstein

[11] 4,019,265

[45] Apr. 26, 1977

[54] UNIVERSAL SIZE DISPOSABLE SHOE COVER

[76] Inventor: Louis S. Epstein, c/o Melco, Inc. 6603 Governor Printz Blvd., Wilmington, Del. 19809

[22] Filed: Mar. 13, 1975

[21] Appl. No.: 558,065

Related U.S. Application Data

[63] Continuation of Ser. No. 338,916, March 7, 1973, Pat. No. 3,898,750.

[52] U.S. Cl. ..... 36/7.1 R; 36/49

[51] Int. Cl.[2] ..... A43B 3/16; A43B 23/00

[58] Field of Search ..... 36/7.1 R, 47, 48, 49, 36/9 R, 9 A, 51, 45; 317/2 B

[56] References Cited

UNITED STATES PATENTS

| | | | |
|---|---|---|---|
| 2,986,823 | 6/1961 | Kos | 36/7.1 R |
| 3,648,109 | 3/1972 | Tims et al. | 36/9 R |
| 3,798,503 | 3/1974 | Larsh et al. | 36/9 R |
| 3,824,714 | 7/1974 | Glassman | 36/7.1 R |

*Primary Examiner*—Patrick D. Lawson
*Attorney, Agent, or Firm*—C. Walter Mortenson

[57] ABSTRACT

This invention provides a unitary blank which is rectangular-like in shape with the sides and the ends of the rectangle being modified so that when the one end and part of the sides are sewn together with an elastic thread in accordance with this invention it is readily formed into a shoe cover which fits snugly a large variety of sizes of shoes. The blank has, in effect, three parts which are the top section, the bottom section and the two side sections. The top section comprises two angularly flared portions each portion extending from a point near the center of the top and going toward its respective side section at a desired angle as is explained hereinafter. The bottom section comprises two rounded sections each extending toward the side section adjacent to it, and the two side sections are portions each of which is in effect a reversing curve joining the rounded bottom section with its related top section. The portion of the blank that lies between each of the top angularly flared portions is a rounded section. When the blank is folded along its longitudinal axis and viewed in the unsewn, folded plan position, the fold resembles the shape of a shoe.

8 Claims, 7 Drawing Figures

UNIVERSAL SIZE DISPOSABLE SHOE COVER

CROSS-REFERENCE TO RELATED APPLICATION

This is a continuation of Ser. No. 338,916, filed Mar. 7, 1973, now U.S. Pat. No. 3,898,750.

BACKGROUND OF THE INVENTION

The present invention is concerned with a disposable shoe covering which can be economically made in such a fashion that it can readily be used to cover a wide variety of sizes equally well. The invention relates to such a shoe covering that additionally can be used in hospitals to prevent and reduce contamination and can be used effectively to prevent explosions in operating rooms through the grounding of the individual wearing the cover of this invention.

DESCRIPTION OF THE PRIOR ART

There are a large variety of patents in this field each of which has its own particular feature, but none of which discloses the shoe covering of this invention that is so adaptable to a wide variety of sizes, effecting coverage equally well. It is well known that shoe coverings can be provided of disposable materials to prevent the accumulation of dirt and dust and microbes and the like, thereby cutting down the spread of disease in hospitals and similar institutions. It is also well known that shoe coverings can be equipped with conductive strips to effect grounding of the wearer of the covering, thereby cutting down or eliminating explosions that have heretofore frequently occurred in operating rooms due to sparks caused by discharge of static electricity.

One of the problems in the art of such shoe coverings is making available to the users in a large variety of institutions the many sizes that are encountered due to the wide variety of people working in such places. Shoe coverings that are readily adaptable to small shoes worn by females are urgently needed as well as shoe coverings that are worn by males having much larger foot sizes. Of course, a wide variety of different shoe coverings can be made available and, indeed, are available. However, the expense involved in the marketing and keeping an inventory of such materials tends to defeat the purposes of the disposability of the shoe coverings. Further complications arise with the turnover of personnel in the various institutions. Still further, prior art devices that are used to cover a variety of shoe sizes invariably involve bunching-up of materials on the bottom part especially in the smaller size uses. This knotting effect causes discomfort in walking.

OBJECTIVES OF THE INVENTION

One objective of this invention is the provision of a disposable shoe covering for shoes. Another purpose is to provide a disposable shoe covering which is inexpensive and is readily made and which will fit a wide variety of foot sizes.

A still further aim of this invention is providing a sanitary covering for shoes which meet the above objectives and which additionally prevents the occurrence of electrical build-up in or on the body of the wearer which build-up is due to the friction effects involved in one's moving around in such a room as an operating room.

A further purpose is the provision of a shoe covering which has a sole portion that lies substantially flat when in use.

These and other objectives appear below.

SUMMARY OF THE INVENTION

The above objectives of this invention are accomplished by the provision of a blank or panel which has a certain shape that affords its conversion to an enclosure by one simple sewing. A partial fold of the blank is effected and at the meeting edges of that partial fold an elastic thread is applied to form a seam and this seam runs from the tip of the toe portion of the resultant shoe to the end of the meeting sections of the partial fold and it then continues around the other edges in a circular, non-seam forming manner and coming back to the end of the said seam. The non-seam forming sewing gathers the side and the heel sections of the shoes together by virtue of the elasticity of the sewing thread. The resultant shoe will stay in the very small form that is created by the puckering of the elastic thread when the wearer having a small shoe size uses this covering. However, when the user is a person wearing a large shoe, the stretching of the covering that occurs when that user places the covering of this invention over his shoe results in the stretching of the entire covering in all directions to cover the shoe adequately. In all cases the bottom of the shoe covering is flat with excellent contact between the floor and the bottom parts of the shoe.

This invention will be further understood by reference to the figures given below along with the description which follows, all of which is given for illustrative purposes and is not limitative.

DESCRIPTION OF THE PREFERRED EMBODIMENT

Figure 3:
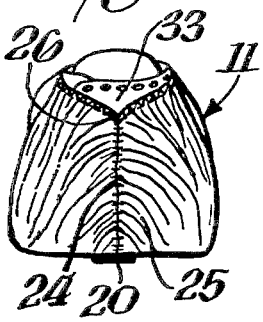
FIG. 3 is a front view of said embodiment in position on a show.
Figure 4:
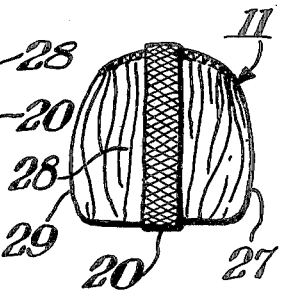
FIG. 4 is a rear elevation view.
Figure 5:
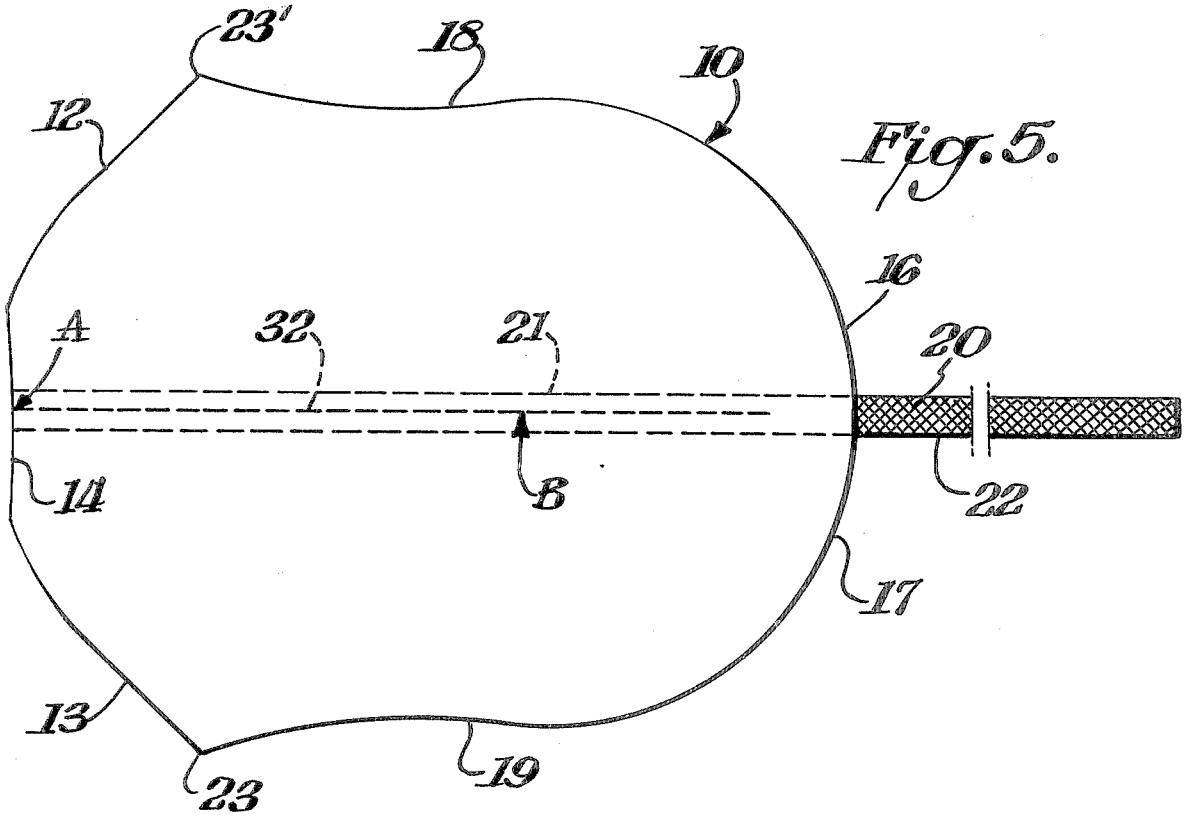
FIG. 5 is a plan of the blank of this invention prior to its formation into the enclosure and showing the conductive strip in position.

With reference to FIG. 5 there is seen a pattern or blank 10 which when sewn in accordance with this invention is readily converted to the shoe covering 11 shown in FIGS. 1–4. The blank is, in effect, a rectangular piece of material which has had its ends and its sides modified. As can be seen at 12 and 13, on end, hereinafter referred to as the top or toe end, has the corners cut off by the angularly flared sections 12 and 13 each extending to its respective side of the imagined rectangle. In between the portions 12 and 13 is the center section 14 which can be a fairly straight section or it can be a rounded section as shown by line 15 in FIG. 6. This center portion actually in the resultant enclosure is the portion that receives the toe or the toe portion of the shoe of the user. The bottom section of the blank 10 shows the corners of the imagined rectangle rounded off, the rounding being shown at 16 and 17. Here again, the modified bottom end of the rectangle extends into the respective side sections. The bottom sections go to form the heel portion of the covering. The side sections 18 and 19 are in effect rounded or reverse curves joining the flared sections 12 and 13 (or 30 and 31 in FIG. 6) with their respective rounded or joining sections 16 and 17.

Figure 6:
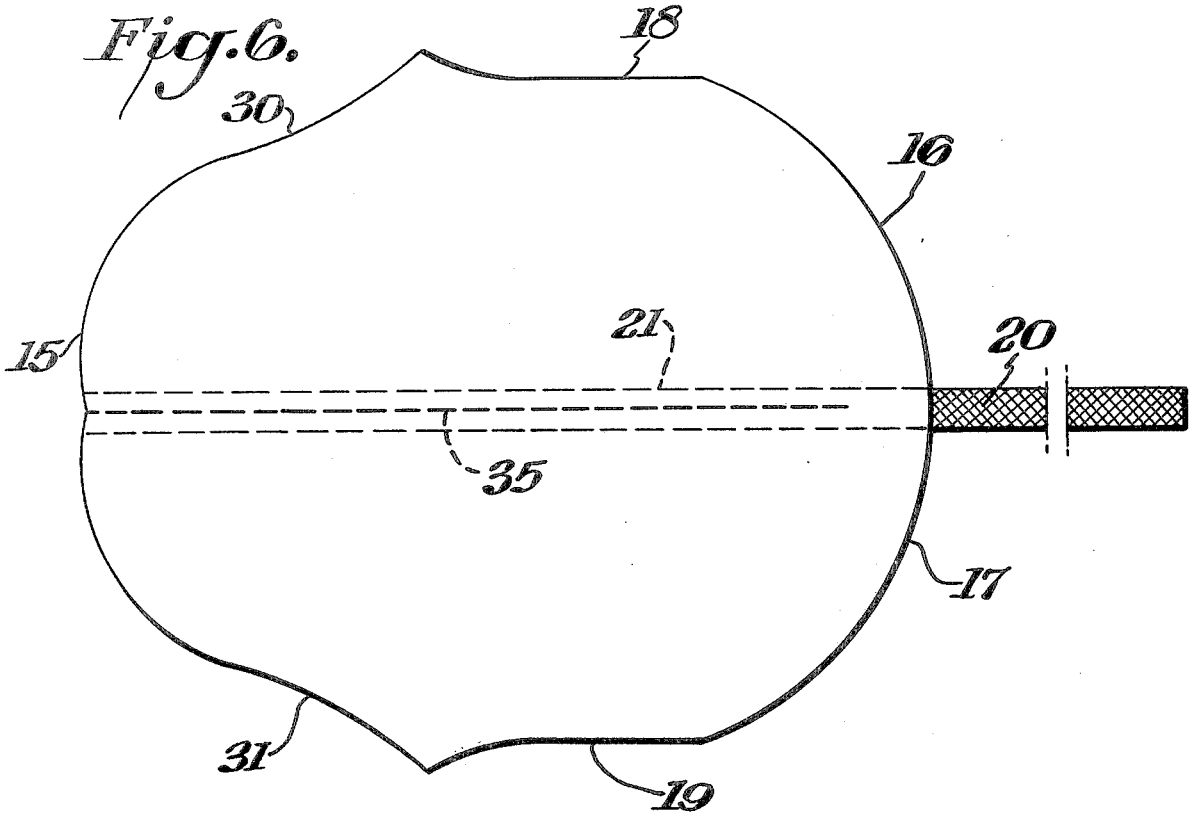
FIG. 6 is a plan view of another embodiment of this invention as the pattern or blank.

Also shown in FIG. 5 and 6 is the conductive strip 20. It is sewn to the blank 10 on the side of the pattern that will form the sole or bottom of the shoe, and it is shown extending from the toe portion at 14 (or 15 in FIG. 6) by the dotted lines 21 all the way to the heel section at 16/17 and extending beyond it, as shown in the solid lines, the solid lines portion being designated by the reference numeral 22. The extending strip 20 is shown in broken form to illustrate that its length is indefinite and can be as long as desired.

When the blank 10 is to be formed into a shoe covering, the manufacturer simply folds the top portion of the blank, or the toe-metatarsus section part, so that the angularly extending section 12 matches and lies on top of the angularly extending section 13. Stated differently, the blank 10 is folded on its longitudinal axis or center line, designated by dotted line 32 in FIG. 5, from a point A to about point B. With the blank in this partially folded condition, the manufacturer then sews, for example, beginning at point 23 with point 23' in lapped position with it, going along the edges of 13/12 to the overlapped center section 14 and around the overlapped sections of 18 and 19 using an elastic thread. This sewing causes an elastic seam 24 (FIG. 2) to be formed running from the very front end of the shoe covering or toe section 25 all the way up to the ankle ending at 26.

This is the only seam in the entire device. The manufacturer of the shoe covering then continues the sewing going around the unlapped edge of the reverse curve 18, the rounded bottom sections 16 and 17, then along the unlapped edges of reverse curve 19 going to the sewn lapped sections of 18 and 19 and, if desired, back to the place of beginning, the lapped 23/23' points. In stitching the unlapped edges, puckering and gathering together of the material occurs forming the side portions of the shoe and the heel portion of the shoe designated as 27, 28 and 29, respectively, in FIG. 2.

Figure 2:
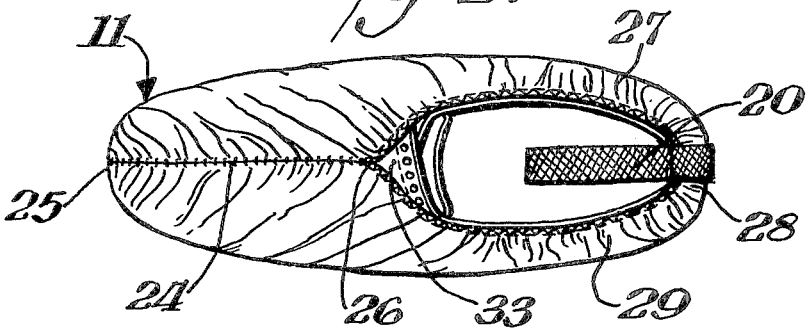
FIG. 2 is a top plan view of the embodiment of the foot covering of this invention (shown in FIG. 1) in position over a shoe with the conductive strip placed inside the shoe, the foot of the wearer being absent.

As can be seen in FIG. 2 and in FIG. 3, both the angularly top sections 12 and 13 being at a modest angle, the shoe covering can be made to stop a bit short of the very front top of the shoe of the wearer, leaving a section of the shoe 33 exposed. In some instances this is desired as, for example, in tying and untying one's shoe. However, in the majority of instances it is preferred to cover the entire shoe. In order to effect that coverage the top angular sections 12 and 13 are made to be more sharply angled to the respective sides as shown by lines 30 and 31 in FIG. 6. When said sharply angled sections are used, a manufacturer, upon effecting the sewing of the elastic thread as described above, creates a shoe covering which rises much higher on the anterior portion of the foot and will cover completely the shoe of the wearer as shown in FIG. 7 at section 34.

Figure 1:
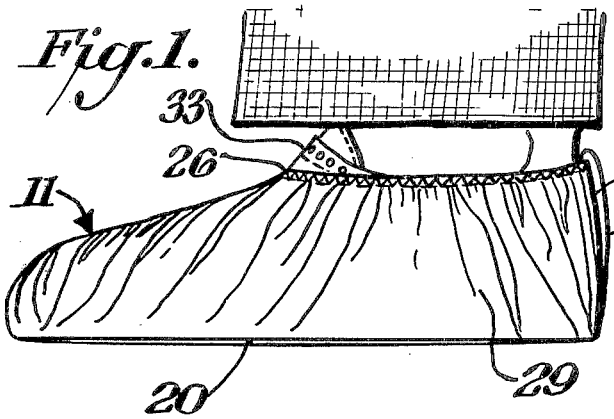
FIG. 1 is a perspective showing one embodiment of the foot covering of this invention in position over the shoe of a given wearer with the conductive strip in one position.
Figure 7:
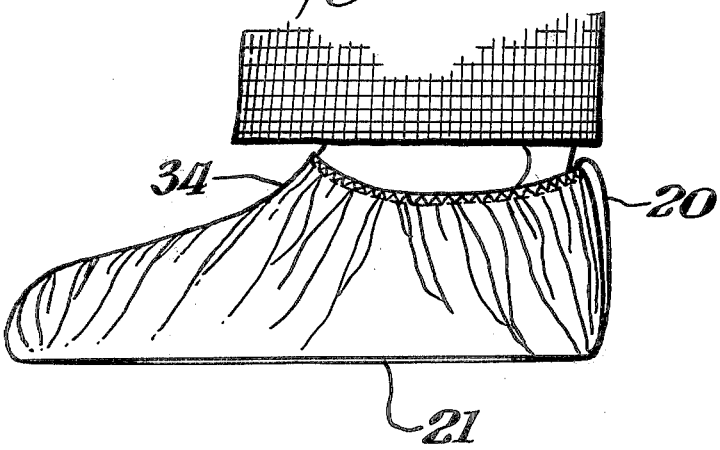
FIG. 7 is a perspective showing the embodiment depicted in FIG. 6 in position over a wearer's shoe.

Also shown in FIGS. 1 and 7 is the conductive strip 20 which extended beyond the bottom or heel section end of blank 10 in FIGS. 5 and 6. It is brought up along the outside of the heel section and is tucked inside the shoe as shown in FIG. 2 to lie on the bottom of the shoe, or it can be tucked into the sock of the wearer (not shown for convenience). FIG. 4 shows the conductive strip 20 at the heel portion of the covering of this invention. The conductive strip lying on the bottom of the shoe, being section 21 shown in FIGS. 5 and 6 can be seen in FIGS. 1, 3 and 7.

The conductive strip 20 can be made of any suitable material such as cloth made of nylon, poly(ethylene terephthalate), rayon, canvas, paper and similar fabric materials. These are filled with a high percentage of carbon or graphite or similar pulverulent,electrically conducting material. This material is kept contained within the pores of the fabric by adhesives in any well-known manner. The strip can be narrow or wide, and strips one-third the width of the blank are frequently used.

The blank 10 can also be constructed of the fabric materials mentioned above as well as muslin, any of the wellknownstretchable materials including a nylon stretch fabric known in the trade as "Hellanca," non-woven papers and paper products such as "Tyvek" available from E. I. du Pont de Nemours and Company, poly(tetrafluorethylene), or any of the many synthetic polymeric materials. In general, all of the parts of the blank and shoe covering of this invention are water-insensitive in normal use and are substantially wear-resistant. Yet, as to the economic aspect the materials used are relatively inexpensive, being available at low cost. Thus, their disposal after only one use is more than economically compatible with the results attained.

One of the distinct advantages of the shoe covering of this invention is that the conductive strip 21 does not have to be and indeed is not a part of any seam. It can be secured to the face of blank 10 that becomes the bottom of the covering by gluing or by sewing or by any such convenient means and in all instances it is made to lie flat and entirely parallel with and in complete contact with that outside section of the shoe covering. In practice one simple stitching shown by dotted line 35 in FIG. 6 can effect the mounting of the strip to the blank. This stitching follows preferably the centerline or longitudinal axis of the blank and runs the full length of blank 10.

Thus, irrespective of the size of the shoe that the user is wearing, the conductive strip 21 will lie substantially in flat contact over substantial portions of its length with the floor. Further, since the conductive strip is not a part of any seam forming the covering of this invention, the length of the conductive strip is not limitative in any way. Therefore, it can extend the full length of the shoe covering. This is a marked advantage over the shoe coverings of the prior art in that many operations are done with the operator being seated on a stool or supporting his or her body in a position whereby only the covered shoe toe portions or one of said toe portions of the person are or is contacting the floor. Since the covers of the shoes of this invention are equipped with the conductive strip and thereby are in contact with the floor even in these positions, the desired protection against static electricity accumulations is attained. Still further, the shoe covering of this invention can be readily and effectively worn by users having shoe sizes as small as size 4 for females and as large as a shoe size 14 as is encountered occasionally among males in hospitals and similar institutions. The formation of knots or bunched material under the foot of the wearer is avoided, and the wearer walks in the normal comfort of his shoes.

While the invention has been disclosed herein in connection with certain embodiments and certain structural and procedural details, it is clear that changes, modifications or equivalents can be used by those skilled in the art; accordingly, such changes within the principles of the invention are intended to be included within the scope of the claims below.

I claim:

1. A shoe covering made from blank, which blank, made from stretchable material, comprises a top section, a bottom comprising two sections and two side sections, the top section being angularly flared from the uppermost part of the top section toward the respective side section, said bottom sections being rounded toward the respective side sections and being flat, the terminal of each rounded bottom section being joined to the terminal of its respective angularly flared top through a curve comprising said side sections, the said covering being formed by a sewing together of the said two angularly flared parts at their edges that meet in a folded form of said blank, said sewing thereby forming a vamp for said shoe in the preparation of said covering.

2. A covering in accordance with claim 1 in which the said sewn edges are sewn together with an elastic thread.

3. A covering in accordance with claim 1 in which the edges of the bottom rounded sections and the edges of said curve contain thread sewn on said edges in a circular fashion as to said vamp.

4. A covering in accordance with claim 3 in which said thread is an elastic thread.

5. A covering in accordance with claim 3 in which said thread is sewn on said edges in a continuous fashion with the thread used in sewing said angular sections together.

6. A covering in accordance with claim 5 in which said thread is elastic.

7. A shoe covering made from a single blank which covering comprises a toe section, two side sections and a heel section, said toe section being formed by a seam made by sewing two portions of said toe section together using an elastic thread, said side sections and said heel section being formed by gathering said section together by means of an elastic thread sewn to the edges of said side and heel sections.

8. A shoe covering in accordance with claim 7 in combination with an electrically conductive strip.

* * * * *

UNITED STATES PATENT OFFICE

CERTIFICATE OF CORRECTION

Patent No. 4,019,265 Dated April 26, 1977

Inventor(s) Louis S. Epstein

It is certified that error appears in the above-identified patent and that said Letters Patent are hereby corrected as shown below:

Column 4, line 22, "wellknownstretchable" should read --- well-known stretchable ---.

Column 4, line 66, "as large as a shoe size 14" should read --- as large as a shoe of the size 14 ---.

Column 5, claim 1, line 6, "section" should read --- sections ---.

Column 5, claim 1, line 12, after "two" to read --- upper ---.

Column 6, claim 7, line 6, "section" second occurrence, should read --- sections ---.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*